United States Patent [19]

Pantzar

[11] 3,995,873

[45] Dec. 7, 1976

[54] SKATEBOARD

[76] Inventor: Richard Cloutier Pantzar, 400 Orion Way, Newport Beach, Calif. 92660

[22] Filed: Nov. 17, 1975

[21] Appl. No.: 632,584

[52] U.S. Cl. ..... 280/87.04 A; 280/11.28

[51] Int. Cl.[2] ..... B62B 3/00

[58] Field of Search ..... 280/11.28, 11.27, 11.19, 280/11.1 R, 11.1 BT, 11.23, 87.04 A; 301/5.3, 5.7

[56] References Cited

UNITED STATES PATENTS

| | | | |
|---|---|---|---|
| 93,110 | 7/1869 | Morris | 280/11.27 |
| 305,434 | 9/1884 | Dean | 280/11.28 |
| 317,501 | 5/1885 | Burton et al. | 280/11.28 |
| 622,218 | 4/1899 | Giljohann | 280/11.28 |
| 1,987,668 | 1/1935 | Coldwell | 280/11.28 |
| 3,362,722 | 1/1968 | Core | 280/87.04 R |
| 3,622,172 | 11/1971 | Goodwin | 280/11.22 |
| 3,795,409 | 3/1974 | Cudmore | 280/87.04 A |

*Primary Examiner*—M. H. Wood, Jr.
*Assistant Examiner*—David M. Mitchell
*Attorney, Agent, or Firm*—Ralph B. Pastoriza

[57] ABSTRACT

The skateboard includes only one forward roller and one rearward roller both of sufficient width to provide stability. Each roller is rotatably supported by a combined fork and fender member which in turn is supported to the underside of the board in a manner to permit swivelling about a journal axis formed at an angle to the longitudinal axis of the board. A cantilevered leaf spring in the main frame portion cooperates with a pinion in the journal for the swivel axis to return the roller to a neutral position.

4 Claims, 9 Drawing Figures

SKATEBOARD

This invention relates generally to skateboards and more particularly to improved roller means positioned on the underside forward and rear portions of the skateboard.

BACKGROUND OF THE INVENTION

All conventional skateboards include four wheels; two wheels on the underside front portion of the board and two wheels on the underside rear portion. It has always been deemed necessary to provide the front and rear wheels in spaced pairs in order that the differential speed of the rollers on the inside of a turn as compared to the outside can be accommodated by the spaced pair of rollers.

The provision of front and rear pairs of rollers has required rather sophisticated mounting means in order to provide a skateboard capable of various maneuvers. Control of a skateboard is almost wholly determined by the distribution of weight on the board surface, the board being caused to turn by shifting the weight from one longitudinal edge of the board to the other. Tilting of the board in this manner is transmitted through the mounting means to the front and rear pairs of wheels to cause them to turn so that the board will thus follow in a curved path generally in the direction of the tilt. As presently constructed, the various supporting arrangements for the rollers or wheels includes some type of resilient means such as thick rubber washers which may be clamped down on the wheel supporting structure in such a manner as to bias the axis of the wheels into a parallel relationship with the bottom surface of the skateboard in which position the wheels are facing forwardly. Changes in the degree of biasing force is generally accomplished by simply tightening a screw.

While skateboards of the foregoing construction have been fairly successful, there are still many problems that arise. One of the major problems is that of proper traction between the wheels and a pavement or other surface on which the skateboard is travelling. Generally, the larger the engagement area of the wheel with the surface, the better is the traction and towards this end, it has become the practice to make the pairs of wheels as wide as possible. However, the width of the wheels is limited since it is undesirable to have the outer sides of the wheels overhang the edge of the skateboard. In such a situation, for example, severe tilting of the board can cause one of the longitudinal edges to engage the wheel and thus stop its rotation with disastrous results.

A second problem is that involved with the swivel mounting of the wheels and the resilient arrangement for returning them to a neutral position. As stated, this is generally accomplished by rubber washers or pads, but these elements can become worn and loose their resiliency. Further, the adjusting means in the form of a threaded screw is not always reliable as it can work loose.

Finally, in the construction of present day skateboards, the turning radius is limited as a consequence of the angulation of the swivelling axis which in most skateboards exceeds 50°(90°would constitute a vertical swivel axis).

BRIEF DESCRIPTION OF THE PRESENT INVENTION

Bearing the foregoing considerations in mind, the present invention contemplates a new type of skateboard representing radical departures from the conventional design, all to the end that the major problems discussed above are substantially overcome.

More particularly, the board includes front and rear roller means disposed beneath the forward and rearward undersides, each of these roller means comprising, in combination a main supporting trunnion frame rigidly secured to the underside of the board and defining spaced, coaxial trunnion openings on a journalling axis extending downwardly from the underside of the board and inwardly towards a point spaced below the center of the board to define an acute angle with the longitudinal axis of the board lying in a vertical plane. This angle is essentially the counterpart to the angle of the swivelling axis of conventional skateboards but in contradistinction thereto, is less than 45°, preferably lying between 30° and 40°.

A fork-fender member has a fork portion rotatably supporting a roller and a fender portion covering a portion of the periphery of the roller and including means defining spaced oppositely directed coaxial pinions lying on an axis oriented at right angles to the axis of rotation of the roller and spaced therefrom. These pinions are receivable and supported by the trunnion openings so that the fork-fender member can swivel about the journalling axis.

In the preferred embodiment, the roller mounted in the fork portion of the fork-fender member constitutes a single wide roller, the width being greater than one half the overall width of the skateboard itself. The front and rear roller means for the skateboard thus each consists of solely one roller so that the entire skateboard only has two rollers, one in a forward position and one in a rear position as opposed to four rollers as conventionally used. A major advantage of the wide single roller is the greatly increased traction and support provided for the skateboard.

The mounting of the fork-fender member by the main frame structure and angulation of the journalling axis as described, permits superior maneuverability to be realized in operating the skateboard, particularly, a much shorter turn radius.

Finally, a unique biasing means is provided for returning the single front roller and single rear roller to their neutral or level positions when the skateboard is level. Essentially, this biasing means takes the form of a leaf spring which acts on a flattened surface portion of one of the pinions in the fork-fender member such that the swivelling is biased to a neutral position.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
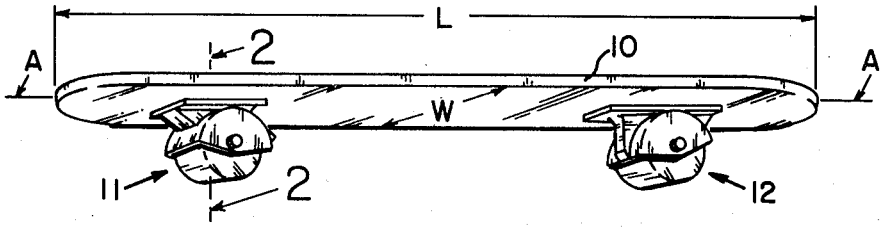
FIG. 1 is a perspective view of the underside of a skateboard made in accord with the present invention.

Referring first to FIG. 1 there is shown a skateboard including an elongated board 10 having a given width W and length L preferably at least three times the width. As shown, front and rear roller means designated generally at 11 and 12 are disposed beneath forward and rearward underside portions of the board. Each of these roller means is identical the same being positioned to form mirror images of each other. Accordingly, a detailed description of one will suffice for both.

Figure 2:
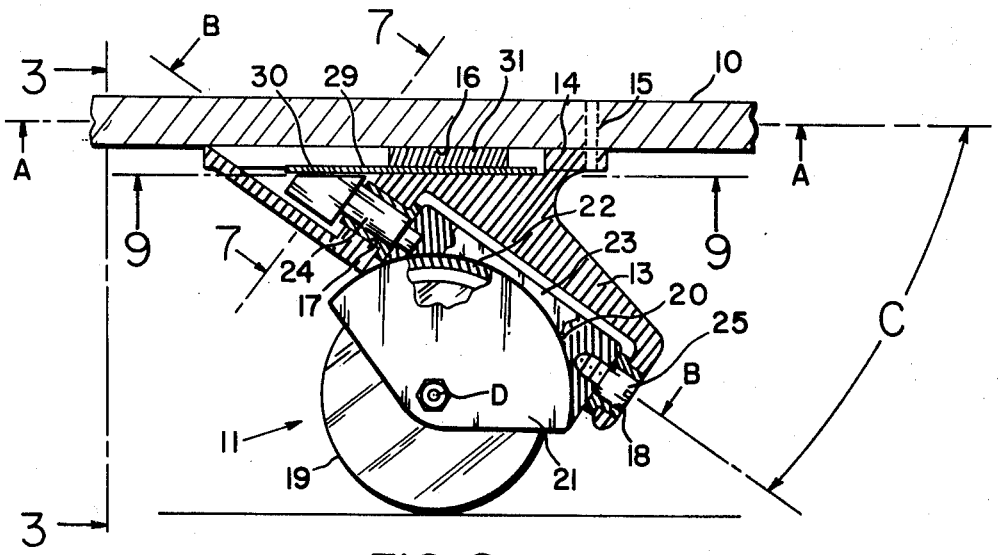
FIG. 2 is a greatly enlarged fragmentary cross section taken in the direction of the arrows 2—2 of FIG. 1 of the forward roller means for the skateboard.

Thus, referring to the enlarged fragmentary cross section of FIG. 2, illustrating the forward roller means 11, the structure includes a main supporting trunnion frame 13 terminating at its upper end in a plate 14 arranged to be rigidly secured as by screws or bolts 15 to the underside portion 16 of the board 10. In FIG. 2 the longitudinal axis of the board 10 is indicated at A—A.

The main frame 13 functions similarly to a yoke structure in that it defines spaced, coaxial trunnion openings 17 and 18 on a journalling axis designated by the letters B—B. As shown, this axis extends downwardly from the underside 16 of the board 10 and inwardly towards a point spaced below the center of the board to define an acute angle C with the longitudinal axis A—A of the board the axes A—A and B—B lying in a vertical plane.

In the preferred embodiment illustrated, there is provided a single roller 19 supported by a fork-fender member designated generally by the numeral 20. This member has a fork portion in the form of side plates, one of which is illustrated at 21 in FIG. 2 for rotatably supporting the roller 19, and a fender portion 22 of cylindrical shape coaxial with the axis of rotation indicated at D for the roller 19 and covering a portion of the upper periphery of the roller.

The upper central portion of the fork-fender member 20 includes means 23 having spaced oppositely directed coaxial pinions 24 and 25 lying on an axis at right angles to the axis D of rotation of the roller and spaced therefrom as shown. These pinions are received in and supported by the trunnion openings 17 and 18 respectively so that the fork-fender member can swivel about the journalling axis B—B relative to the main frame 13 and board 10.

Figure 3:
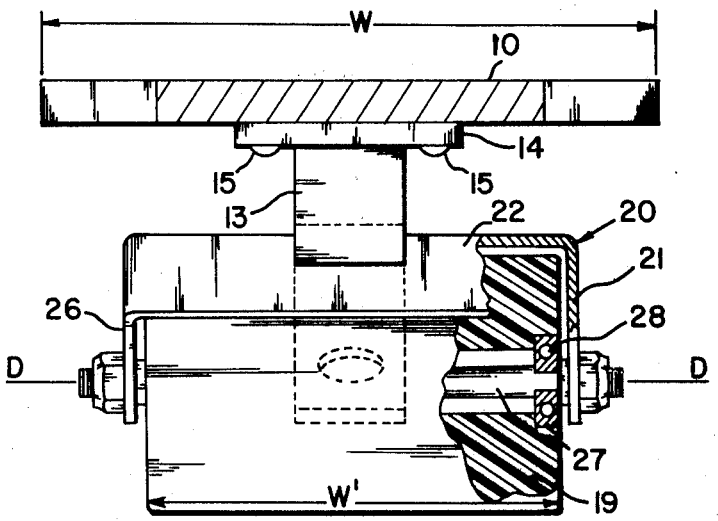
FIG. 3 is a front elevational view partly broken away looking in the direction of the arrows 3—3 of FIG. 2.

Referring to the front view of FIG. 3, it will be evident that the width of the single roller 19 indicated at W′ is of a substantial extent and in all instances is at least as great as one half the overall width W of the skateboard 10. In FIG. 3, the opposite plate to the plate 21 described in FIG. 2 is shown at 26, these plates forming the end of the cylindrical shape 22 forming the fender portion. The roller 19 includes an axle 27 having opposite ends supported in the plates 21 and 26 respectively as by ball bearings such as shown at 28 for the right hand end of the axle 27 as viewed in FIG. 3.

Figure 4:
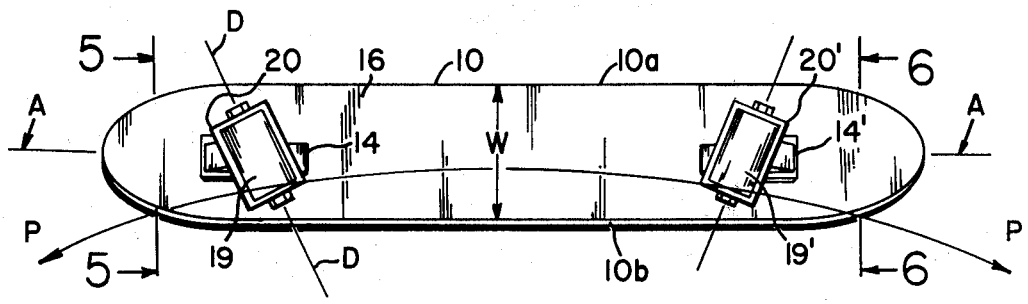
FIG. 4 is a bottom plan view of the skateboard roller means showing the skateboard in a tilted position.

Referring now to the underside view of FIG. 4, the operation of the heretofore described mounting arrangement for the rollers will become evident. In viewing FIG. 4, the skateboard should be imagined as on a glass surface with the viewer beneath the glass looking up at the bottom. As indicated in FIG. 4, the board 10 is tilted slightly which would result from a skater placing more weight on one longitudinal edge of the board than the other. Thus in FIG. 4, the longitudinal edges of the board 10 are illustrated at **10*a* and 10*b*, the edge 10*b* being closer to the view than the edge 10*a*** as a consequence of a tilting of the board.

When tilted in the foregoing manner, the roller 19 and supporting fork-fender member 20 will be caused to swivel in a direction towards the tilt such that the roller axis D forms an angle with the longitudinal axis A—A of the board 10. In FIG. 4, the rearward roller and fork-fender members are designated by corresponding numerals followed by a prime and it will be noted that because of the mirror image orientation, the swivelling takes place in an opposite direction.

The resulting swivelling action causes the skateboard to follow a curved path designated by the dashed line P—P, the radius of this curve in the direction towards the center of the curve being in the direction of the tilt; that is, downwardly as viewed in FIG. 4.

Figure 5:
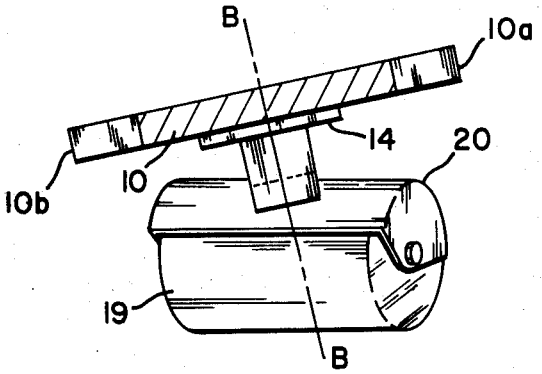
FIG. 5 is a front elevation partly in cross section looking in the direction of the arrows 5—5 of FIG. 4.
Figure 6:
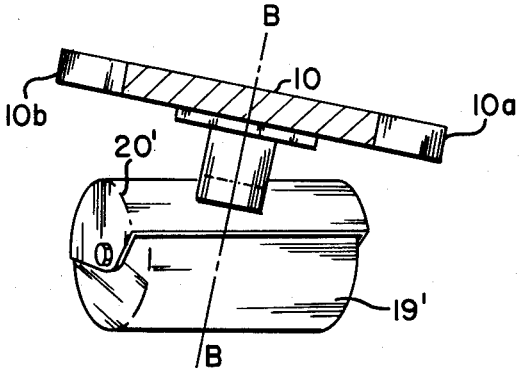
FIG. 6 is a view similar to FIG. 5 but looking in the direction of the arrows 6—6 of FIG. 4.

FIGS. 5 and 6 looking in the direction of the arrows 5—5 and 6—6 respectively illustrate the front and rear rollers and fork-fender assemblies as they would appear when the board 10 is tilted as described in FIG. 4. The degree of turning of the rollers relative to the degree of tilt of the skateboard is determined by the angle C of the swivelling axis as described in FIG. 2. In the present invention this angle is between 30° and 40° and as a consequence, a fairly short turning radius for the entire skateboard is realizable. An advantage of the fender portion of the fork-fender members on the front and rear roller means will now become evident. Specifically, if the tilt of the board is excessive to the point where the outer underside edges might otherwise engage the outsides of the wheels, the wheels themselves are protected by the presence of the fenders in the form of the cylindrical coverings. Thus there is avoided the possibility of the board engaging the roller or wheel in a sharp turn which could freeze its rotation and cause a disastrous accident.

When the skateboard 10 is level, the rollers and associated fork-fender members are in neutral positions wherein the rollers are directed forwardly in the direction of the longitudinal axis of the board. In this orientation, the journalling axis B—B is in a vertical plane which bisects each of the rollers. As in conventional skateboards, it is desirable to bias the fork-fender members and associated rollers to their neutral positions so that the board will normally travel in a straight line and will not turn unless an intentional weight shift by the skater takes place.

In accord with the present invention, biasing of the fork-fender members and rollers to their neutral positions is accomplished by means of a cantilevered leaf spring. Referring back to FIG. 2, this cantilevered leaf spring is shown at 29 positioned parallel to and spaced from the underside of the board 10 in a position juxtaposed the pinion 24. As indicated in FIG. 2, the pinion 24 has a flattened side 30 engaging the free end of the leaf spring 29 when the board is level so that the fork-fender member 20 is in its neutral position.

Figure 7:
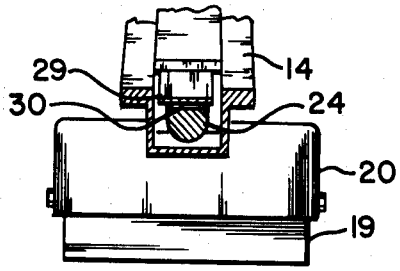
FIG. 7 is a cross section partly schematic in nature looking in the direction of the arrows 7—7 of FIG. 2 showing the relative positions of various parts when the skateboard is level.

Referring now to the cross section of the front of the pinion 24 looking in the direction of the arrows 7—7 of FIG. 2 as illustrated in FIG. 7, the fork-fender member 20 is shown in the referred to neutral position with the cantilevered leaf spring 29 engaging the flattened surface or side 30 of the pinion 24.

Figure 8:
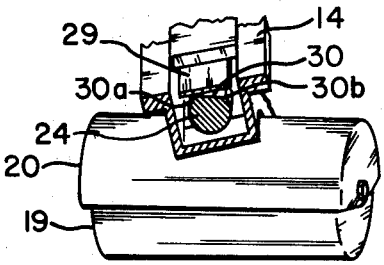
FIG. 8 is a view similar to FIG. 7 but illustrating modified positions of the components when the skateboard is tilted; and, FIG. 9 is a cross section looking upwardly in the direction of the arrows 9—9 of FIG. 2, useful in explaining certain portions of the operation as depicted in FIGS. 7 and 8.

Referring now to FIG. 8, there is shown the result of a swivelling of the fork-fender member 20 relative to the skateboard 10 and mounting plate 14, the latter being shown as tilted and the former being shown in the same orientation as FIG. 7. In the relative positions illustrated in FIG. 8 it will be noted that the free end of the leaf spring 29 now engages an edge designated 30*a* of the flattened side of the pinion, this action resulting from a camming of the leaf spring by the pinion in an upward direction towards the underside of the board or supporting plate 14. As a result, a biasing force is exerted on the edge 30*a* of the flattened side of the pinion tending to return the fork-fender member and its associated roller to its neutral position.

It will be understood that should the tilting of the board take place in an opposite direction, the other edge 30*b* of the flattened side of the pinion 24 would cam the leaf spring 29 upwardly thereby causing a biasing force to be exerted on this side again tending to level the board.

Figure 9:
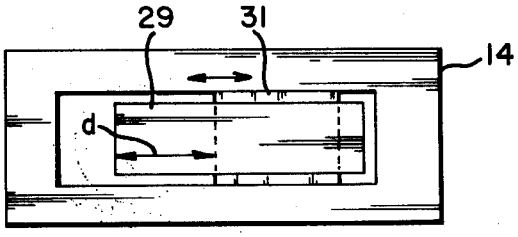

In the foregoing construction, it is highly desirable to provide a simple and effective means of adjusting the biasing force exerted by the leaf spring. In accord with the present invention, this adjustment is accomplished by providing a slide block 31 between a portion of the leaf spring 29 and the underside of the board, this slide block being clearly illustrated in FIG. 2 and in FIG. 9. Essentially, the slide block is movable in a longitudinal direction towards the free end of the cantilevered leaf spring 30 to effectively change the length of the free end. In FIG. 9 this length is designated by the letter *d.*

It will be appreciated that the shorter the length *d* or length of the free end of the cantilevered leaf spring the greater will be the biasing force exerted by the leaf sprin when deflected by the flattened side of the pinion and thus the greater will be the force tending to move the fork-fender member and associated roller to its neutral position. Sliding of the slide block 31 in an opposite direction to effectively increase the cantilevered length portion of the leaf spring will diminish the biasing force.

The rear roller means includes a similar biasing arrangement which can be independently adjusted.

From the foregoing description, it will be evident that the skateboard of the present invention provides distinct advantages over conventional skateboards. The provision of only single front and rear rollers or wheels simplifies the construction and increases the traction area of engagement of the rollers with the surface upon which the skateboard is used. Further, the decrease in the acute angle of the swivel axis relative to the longitudinal axis of the board as compared to conventional skateboards provides a substantially shorter turning radius. The provision of the cylindrical shape constituting the fender portion of the fork-fender member, which cylindrical shape preferably extends between ¼ and ½ the upper periphery of the roller, not only protects the rollers from inadvertent engagement by the under edges of the skateboard under severe tilting conditions but also provides an extremely attractive appearance for the overall structure.

Finally, and as mentioned heretofore, the unique biasing means in the form of the cantilevered spring assures a consistent and reliable means for returning the rollers to neutral positions which means can be readily adjusted. Should the leaf spring become worn, it is extremely simple to replace it with a new one.

While the preferred embodiment of this invention contemplates the provision of solely one front roller or wheel and one rear roller or wheel, is is, of course, possible to divide the front and rear rollers into roller pairs independently mounted on the axle to accommodate differential speeds when travelling on curves. However, the preferred embodiment in the form of the single roller on the front and the single roller on the rear is found to provide substantially as effective operation for the board notwithstanding the tendency for the opposite ends of the roller to travel at different speeds when rounding curves.

Accordingly, the skateboard is not to be thought of as limited to the exact details in the specific embodiment set forth for illustrative purposes.

What is claimed is:

1. A skateboard including an elongated board having a given width and length at least three times said width and front and rear roller means disposed beneath forward and rearward underside portions of said board, each of said roller means comprising, in combination:

a. a main supporting trunnion frame rigidly secured to the underside of the board and defining spaced coaxial trunnion openings on a journalling axis extending downwardly from the underside of the board and inwardly towards a point space below the center of the board to define an acute angle with the longitudinal axis of the board lying in a vertical plane;

b. a roller;

c. a fork-fender member having a fork portion rotatably supporting said roller and a fender portion covering a portion of the periphery of said roller and including means defining spaced oppositely directed coaxial pinions lying on an axis oriented at right angles to the axis of rotation of said roller and spaced therefrom, said pinions being receivable in and supported by said trunnion openings so that said fork-fender member can swivel about said journalling axis whereby when a skater places more weight on one longitudinal edge portion of the board than the other to tilt the board, each of the fork-fender members are caused to swivel in opposite directions simultaneously from neutral positions to turn the forward roller towards the direction of the tilt and the rearward roller in an opposite direction as viewed in plan to thereby cause the skateboard to follow a curved path, the radius of the curve in a direction towards the center of the curve being in the direction of the tilt; and d. a leaf spring positioned in said main frame and spaced from the underside of the board in a position juxtaposed to one of said pinions, said one of said pinions having a flattened side engaging said leaf spring when said board is level so that said fork-fender member is in its neutral position, swivelling of the fork-fender member causing said one pinion to cam said leaf spring towards the underside of said board so that a bias force is exerted on an edge of the flattened portion of said one pinion tending to return the fork-fender member to its neutral position.

2. A skateboard according to claim 1, in which said roller is a sole roller of width in the axial direction of the roller at least equal to one half the width of said board such that the rollers for the skateboard consist solely of two, one in a forward position and one in a rearward position, and such that each journalling axis is in a vertical plane which bisects the rollers when the board is level and said fork-fender members are in their neutral positions.

3. A skateboard according to claim 1, in which said leaf spring is cantilevered and wherein there is provided a slide block between a portion of said leaf spring and the underside of said board, said slide block being movable towards the free end of said cantilevered leaf spring to effectively change the length of the free end and thereby the biasing force exerted by the leaf spring on said one pinion.

4. A skateboard according to claim 1, in which the fender portion of said fork-fender member is of cylindrical shape to cover between one-fourth and one-half the upper periphery of said roller in coaxial relation thereto, the fork portion constituting side plates at the ends of said cylindrical shape, said roller having an axle supported in said side plates.

* * * * *